United States Patent [19]

Wurst

[11] 4,114,581

[45] Sep. 19, 1978

[54] PULSE-SUPPLIED IGNITION SYSTEM FOR INTERNAL COMBUSTION ENGINES

[75] Inventor: Bert Wurst, Möglingen, Germany

[73] Assignee: Robert Bosch GmbH, Stuttgart, Germany

[21] Appl. No.: 704,564

[22] Filed: Jul. 12, 1976

[30] Foreign Application Priority Data

Jul. 12, 1975 [DE] Fed. Rep. of Germany ..... 2531302

[51] Int. Cl.[2] ..... F02P 3/04

[52] U.S. Cl. ..... 123/148 E

[58] Field of Search ..... 123/148 E, 148 CA, 117 R; 315/209 T, 208 SC, 209 M, 209 CD, 180

[56] References Cited

U.S. PATENT DOCUMENTS

| | | | |
|---|---|---|---|
| 3,575,154 | 4/1971 | Taylor | 315/209 T |
| 3,605,713 | 9/1971 | Masters et al. | 123/148 E |
| 3,877,453 | 4/1975 | Brungsberg | 123/148 E |

*Primary Examiner*—Samuel Feinberg

*Attorney, Agent, or Firm*—Flynn & Frishauf

[57] ABSTRACT

The ignition coil has a tapped primary winding which forms a first partial primary portion and a second primary portion, the second primary portion having an inductance which is high with respect to the partial primary portion. A supply circuit, including a controlled switch, is connected in circuit with the first partial portion to energize the partial portion when the controlled switch is closed, so that the partial portion is energized in successive pulses separated by time intervals. A shunt circuit is connected to the second primary portion and carries the induced current during gaps in energization pulses applied to the primary partial portion and arising at the end of the pulses, both the shunt and the main energization circuits being interrupted at the ignition instant to thereby produce a high-voltage pulse in the secondary. The pulsed current supplied to the primary saves current and loading of the ignition coil.

10 Claims, 2 Drawing Figures

PULSE-SUPPLIED IGNITION SYSTEM FOR INTERNAL COMBUSTION ENGINES

Cross reference to related applications: U.S. Ser. No. 703,780, filed July 9, 1976 Werner JUNDT et al; and U.S. Ser. No. 704,116, filed July 9, 1976 Bernd BODIG et al; both assigned to the assignee of the present application.

The present invention relates to an ignition system for internal combustion engines, and more particularly to a system which uses an ignition coil to store energy to provide a spark at the spark plug.

It has previously been proposed (see Document U.S. Pat. No. 3,877,453, Brungsberg to generate ignition sparks where an ignition coil is used which has a tapped primary. The primary winding, therefore, has a first partial portion and a second partial portion, which are serially connected. The two partial portions are switch controlled, typically by a pair of transistors. One transistor is connected in series with both partial portions and the other is connected across one of the partial portions. Upon initiation of an ignition event, both transistors are controlled to be initially conductive, so that a comparatively large current can flow through the first partial portion. The first transistor is then controlled to block, so that current can continue to flow through both partial portions. Control of the first transistor is effected by means of an additional winding placed on the ignition coil. This complicates the construction of the ignition coil and may result in stray induced voltages in the additional winding, which may result in erroneous control of the transistor connected thereto, and, in extreme cases, may even cause damage.

The ignition system is so arranged that ignition energy is initially stored only in the first partial winding. Thus, the current necessary to store sufficient ignition energy is reached rapidly so that, even at high operating speeds of the engine, sufficient ignition energy is being provided. As soon as sufficient current flows, it is conducted over both the first and second partial portions of the primary winding. Due to the higher number of windings it is possible to store the energy necessary for ignition with a lower current flow. The entire current consumption, and hence the loading on the ignition coil is substantially decreased, which is particularly important when the internal combustion engine operates at low speeds.

It is an object of the present invention to provide an ignition system of the type referred to without, however, the disadvantages and complications of prior structures.

Subject matter of the present invention: Briefly, a sensing resistor is provided connected to have the current flowing through the ignition coil also flowing therehrough; a monitoring or sensing circuit is connected in parallel to the sensing resistor, and includes an electronic sensing switch which controls the transistor connected in shunt with the second partial primary portion.

The invention will be described by way of example with reference to the accompanying drawings, wherein.

Figure 1:
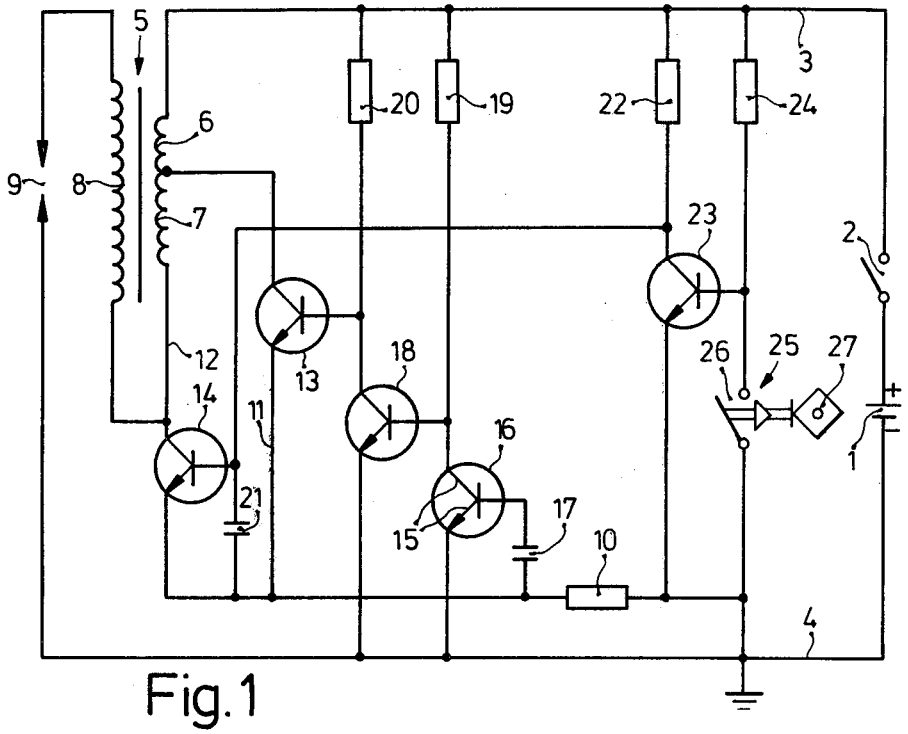
FIG. 1 is a schematic circuit diagram of an ignition system in accordance with the present invention.

Referring first to FIG. 1: An internal combustion engine, not shown, and typically an automotive-type internal combustion engine, has a battery 1 to supply the ignition system with electrical power. The positive terminal of battery 1 is connected through ignition switch 2 to a positive bus 3; the negative terminal of battery 1 is connected to ground or chassis of the vehicle shown as chassis bus 4. Ignition energy is stored in an ignition coil 5 which has primary winding consisting of two partial primary portions 6 and 7. Preferably, the number of turns of the second partial portion 7 is higher than that of the first partial portion 6. Secondary winding 8 of the ignition coil 5 is connected to a spark plug 9, the other terminal of which is connected to chassis bus 4, as well known. Of course, a distributor can be interposed between spark plug 9 and secondary 8, if the engine is a multi-cylinder engine, to distribute the spark energy in accordance with the firing sequence of the engine.

The first partial primary 6 is connected to positive bus 3 and has its other terminal connected to two circuit branches which are in parallel, circuit branch 11 including a controlled switch formed by transistor 13 and circuit branch 12 including the series connected second partial primary 7 and a controlled switch formed by transistor 14. The two branches 11, 12 are serially connected through a sensing resistor 10 to chassis bus 4. Both transistors 13, 14, which are npn transistors, have their emitters connected to the sensing resistors 10. The sensing resistor 10 has a sensing circuit connected in parallel thereto, which includes the control path of a controlled switch 15 formed by an npn transistor 16. The control path, here, is the base-emitter path of transistor 16. The sensing branch further includes a capacitor 17 connected to the base of transistor 16; the emitter of transistor 16 is connected to chasis bus 4. The collector of transistor 16 is connected to the base of an npn coupling transistor 18 and through a collector resistor 19 to positive bus 3. Coupling transistor 18 has its emitter connected to bus 4. Its collector is connected to the base of transistor 13 in first branch 11 and, further, through a collector resistor 20 to positive bus 3.

Positive bus 3 is connected to a charge circuit for a control capacitor 21, supplied over resistor 22 from positive bus 3. Capacitor 21 is connected through sensing resistor 10 to chassis bus 4. Control capacitor 21 is connected in parallel to the base-emitter path of the transistor 14 by being connected to the base thereof; additionally, it is connected to the collector of a transistor 23, the emitter of which is connected to chassis bus 4. The base of transistor 23 is connected through a resistor 24 to the positive bus 3 and through a breaker switch 25 to chassis bus 4.

The breaker switch 25 is shown as a well-known breaker terminal assembly 26, operated from the breaker cam 27 of the internal combustion engine. Switch 25 may be any type of control switch for the ignition system, however, for example the emitter-collector path of a transistor which is controlled in noncontacting manner from a shaft rotating in synchronism with the internal combustion engine, for example by means of a magnetic transducer assembly operating similarly to an a-c generator; if desirable, one or more flip-flop stages may be interposed. Other ignition control systems may also be used.

Figure 4:
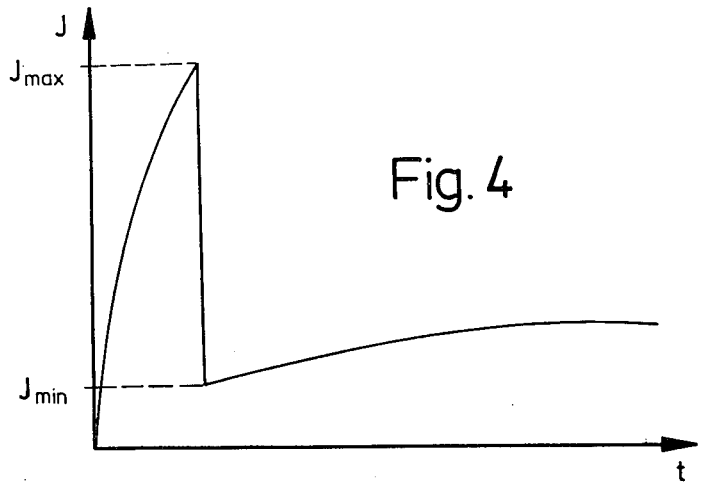
FIG. 4 is a current (ordinate) vs. time (abscissa) diagram illustrating current flow when ignition energy is being stored.

Operation — with reference also to FIG. 4: The system is ready for operation when ignition switch 2 is closed. During operation, switch 25 is controlled to become conductive. The emitter-collector path of transistor 23 will thus block since control current is lacking. The control capacitor 21 can charge through resistor 22 and current sensing resistor 10. The voltage across control capacitor 21 will rise exponentially. In dependence on this exponentially rising voltage, the second transistor 14 will gradually change to pass more and more current through its emitter-collector path. Simultaneously with the current flowing through the capacitor 21, a branch current flow will be established through the monitoring capacitor 17 and the base-emitter path of transistor 16. The emitter-collector path of transistor 16, forming the sensing or monitoring switch 15, will thus become conductive, i.e. switch 15 will close. The emitter-collector path of coupling transistor 18 will then block and the emitter-collector path of the transistor 13 in the first branch 11 will become conductive. Thus, current will flow through the first partial primary 6 and rise rapidly due to the short-circuiting effect of transistor 13 of the branch 7 and the only partially conductive transistor 14, thus effecting rapid storage of substantial energy for an intense spark if ignition should be commanded at that time. When this energy has been stored, the rate of current flow through capacitor 17 as well as the base-emitter path of transistor 16 will have dropped to such an extent that the switch 15 formed by transistor 16 will open, that is, transistor 16 will block. This controls the emitter-collector path of coupling transistor 18 to conductive state and hence the emitter-collector path of the first transistor 13 in the first branch to blocking state. In the meanwhile, the second transistor 14, which has become fully conductive, permits current flow from the first partial primary portion 6 through the second partial primary portion 7. Due to the higher number of windings, a lesser current flow will occur through the coil, while continuing to store the previously stored ignition energy in coil 5.

At the ignition instant, commanded for example by the cam 27 or by other systems or networks, switch 25 will open so that the connection between the base of transistor 23 and chassis bus 4 will be interrupted. Transistor 23 now receives control current through resistor 24, causing the collector-emitter path of transistor 23 to become conductive. This discharges the control capacitor 21. The second transistor 14 will be controlled to block rapidly, resulting in a high-voltage pulse in the secondary 8 of coil 5 which causes sparking at spark plug 9.

Upon subsequent connection of switch 25, the cycle will repeat.

The current-time diagram of FIG. 4 illustrates this sequence. Initially, the current flowing over the first partial portion 6, transistor 13, and sensing resistor 10 rises rapidly in exponential manner due to the low ohmic resistance and the inductance thereof. The ignition coil 5 will have stored sufficient energy for an effective spark at spark plug 9 when the current through the first partial primary 6 has reached the value $J_{max}$. At this instant, the current is now conducted to flow serially through both partial primary portions 6 and 7 as well as through the sensing resistor 10. Initially this causes a drop of current flow to a value $J_{min}$. Thereafter, the current will rise exponentially through both partial portions 6, 7 and the monitoring or sensing resistor 10 due to the effect of capacitor 21. The exponential rise is substantially flatter and more gradual than initially when ignition energy was being stored rapidly.

As the speed of the internal combustion engine increases, the ignition voltage decreases somewhat. This permits an arrangement of extremely high sparking energy at low engine speeds, for example upon starting, and normal sparking energy at higher engine speeds.

Figure 2:
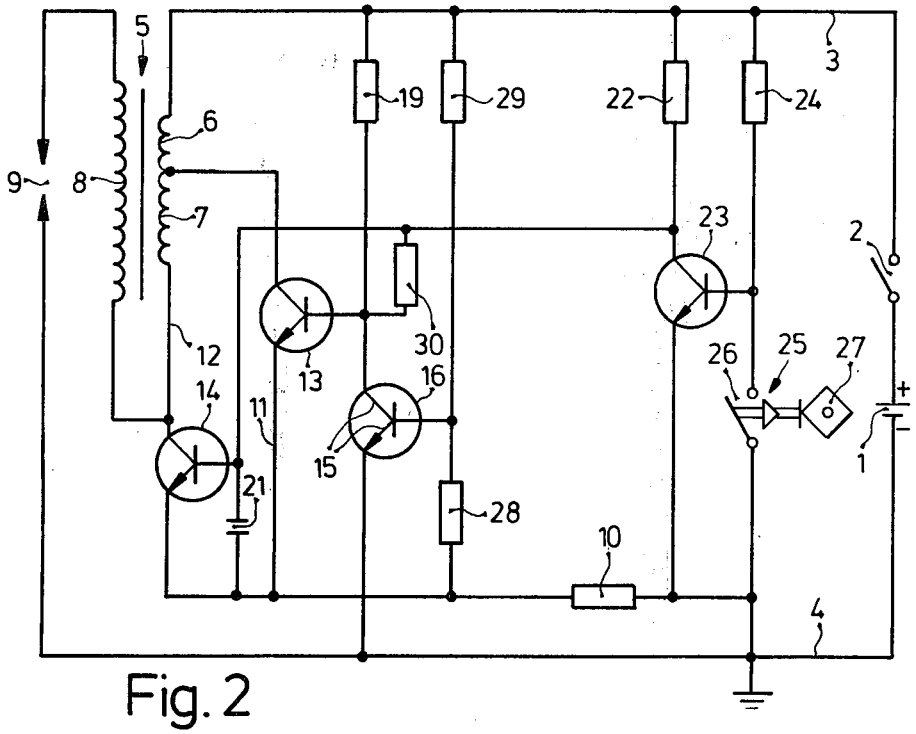
FIGS. 2 and 3 are schematic circuit diagrams of different embodiments of the system of the present invention.

Referring now to FIG. 2: The difference between the embodiment of FIG. 2 and that of FIG. 1 is the replacement of the capacitor 17 of the monitoring circuit 15 by a resistor 28 which, together with a resistor 29 connected to positive bus 3, forms a voltage divider controlling transistor 16. The coupling transistor 18 is then no longer used. The collector of transistor 16 is connected to the base of the first transistor 13. A resistor 30 is connected between the base of transistor 13 and the base of transistor 14.

Operation of the circuit of FIG. 2: As the control capacitor 21 charges upon closing of switch 25, a control current will flow over resistor 30 to the base-emitter path of the first transistor 13, rendering the transistor conductive and thus permitting current to flow through the collector-emitter path thereof. When this current has risen to a value high enough that the energy stored in coil 5 can provide an effective spark, the branch current flowing through the base-emitter circuit of the transistor 16 will render transistor 16 to become conductive, so that the switch 15 will close. Upon transistor 16 being conductive, the emitter-collector path of the first transistor 13 is controlled to change to blocking state. In the meanwhile, the emitter-collector path of the second transistor 14 has become conductive and permits current to flow through th partial coil portions 6 and 7, connected in series, to maintain the stored energy in coil 5 until it is needed at the ignition instant to provide the spark.

Figure 3:
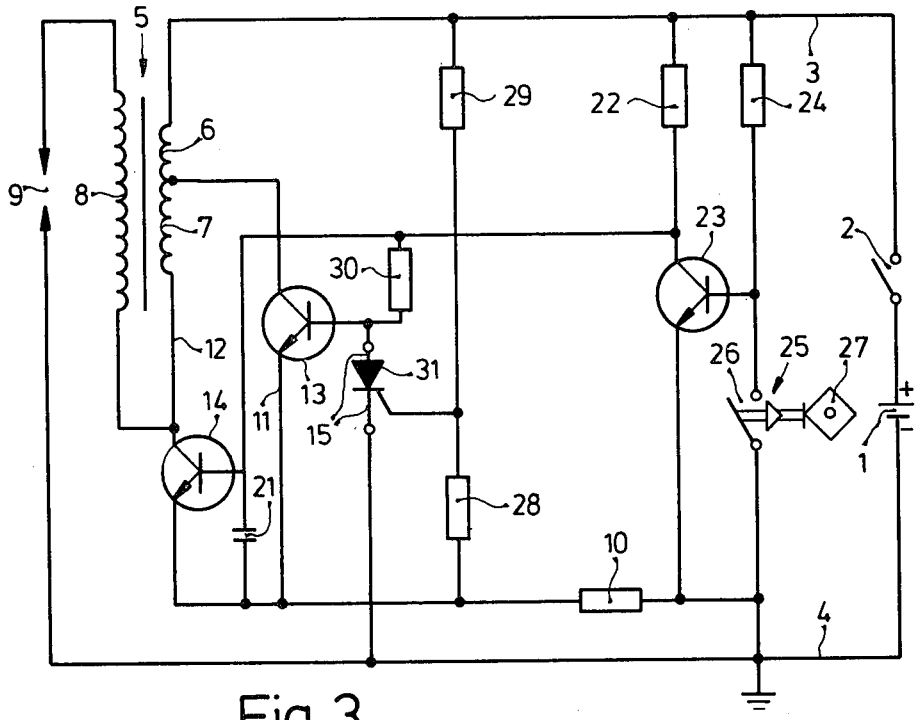

Embodiment of FIG. 3: The monitoring switch 15 in the embodiment of FIG. 3 is formed by the anode-cathode path of a thyristor 31. The gate electrode is connected to resistor 28, the cathode to the chassis bus 4. The anode is connected to the base of transistor 13 which, as before, is connected through resistor 30 to the base of resistor 14. Resistor 19 is not needed.

Operation of the circuit of FIG. 3: The anode-cathode path of thyristor 13, forming switch 15, is switched into conductive condition similarly to the control of the emitter-collector path of transistor 16 of FIG. 2. The operation is similar to that described in connection with FIG. 2. The anode-cathode path of thyristor 31 is returned to non-conductive state at the ignition instant, since the emitter-collector path of transistor 23 then becomes conductive, thus causing collapse of the voltage across thyristor 31 by placing the anode of thyristor 31 at practically the same voltage as the chassis bus 4.

Various changes and modifications may be made and features described in connection with anyone of the embodiments may be used with any one of the others, within the scope of the inventive concept.

Preferably, the partial primaries 6, 7 have the following inductance relationships, in which $L_6$ indicates the inductance of the first partial primary portion 6 and $L_{67}$ the inductance of the series connection of both partial primary portions 6 and 7:

$\frac{1}{2} L_6 \cdot J^2_{max}$ should be approximately equal to $\frac{1}{2} L_{67} \cdot J^2_{min}$.

I claim:

1. Ignition system for an internal combustion engine having an ignition coil (5) with a tapped primary winding to provide a first partial primary (6) and a second partial primary (7), serially connected with the first partial primary (6);

a first switchable control circuit (11, 13) connected to the tap point of the primary winding, in series with the first partial primary (6) and comprising a first controlled switch (13);

a second switchable control circuit (12) comprising the second partial primary (7) and a second controlled switch (14);

and means (25, 22, 23, 21) controlling connection of the controlled switches (13, 14) to energize the coil a sensing resistor (10) connected in circuit with said first control circuit (11) and sensing when current through the first partial primary (6) has reached a predetermined value, a control capacitor (21) connected in series with said sensing resistor (10) to have its charge current controlled by current flow through the sensing resistor (10), the control capacitor being connected to the control terminal of the second controlled switch (14) of the second control circuit, a control circuit (15; 16, 17; 16, 28, 29; 31, 28, 29, 30) connected to and controlled by current flow through said sensing resistor (10) and controlling the switching state of said first controlled switch (13) to control current flow through said first controlled switch (13) and hence through said first partial primary and provide for rapid rise in stored energy in the coil (5) and, when the current flow through said first partial primary and the sensing resistor (10) has reached the predetermined value, to control said first controlled switch (13) to open and provide for current flow through said first and second partial primaries (6, 7) at a low value whereby said sensing resistor (10) will control change-of-state of said first controlled switch (13), said series circuit of the resistor (10) and the control capacitor (21) controlling the second controlled switch to be in conductive state when the first controlled switch (13) opens to permit continued current flow through both the first partial primary (6) and the second partial primary (7) of the primary winding of the ignition coil;

and an ignition control switching means (25) connected to supply charging current for said control capacitor (21) upon closing of said ignition control switching means to current supplying state.

2. System according to claim 1, wherein said control circuit (15; 16, 17; 16, 28, 29; 31, 28, 29, 30) includes the control path of an electronic semiconductor switch (15), change-of-state of said electronic semiconductor switch (15) controlling switch-over of said first controlled switch (13) to blocked state.

3. System according to claim 2, wherein the control path of said electronic semiconductor switch (15) is connected across the sensing resistor (10), voltage drop across said sensing resistor, upon current flow at said predetermined value, controlling change-over of the state of said electronic semiconductor switch (15) and, in turn, controlling blocking of the first controlled switch (13).

4. System according to claim 3, wherein said first and second controlled switches (13, 14) comprise transistors having their respective emitter-collector paths connected in series with the respective partial primaries (6, 7), said first switchable control circuit (11, 13) being connected in shunt to said second control circuit (12, 14) to provide for current flow, serially, through both said partial primaries (6, 7) when the first transistor (13) is in blocked, or open state.

5. System according to claim 2, wherein the electronic semiconductor switch (15) comprises a transistor (16), the emitter-collector path thereof forming the main current path and being connected to control conduction of said first controlled switch (13) (FIG. 1).

6. System according to claim 5, further comprising an monitoring capacitor (17) connected between the base of the transistor (16) forming the electronic semiconductor switch (15) and the sensing resistor (10).

7. System according to claim 2, further comprising a coupling resistor (30) connected between the bases of the two respective controlled switches (13, 14) (FIGS. 2, 3).

8. System according to claim 2, wherein the electronic semiconductor switch (15) comprises a thyristor (31) (FIG. 3).

9. System according to claim 2, further comprising a coupling resistor (28) connected between the sensing resistor (10) and the control electrode of the electronic semiconductor switch (15; 16, 31), the terminal of the sensing resistor which is not connected to the control electrode of the electronic semiconductor switch (15; 16, 31) being connected to the main current carrying path of said electronic semiconductor switch (15; 16, 31);

and wherein said main current carrying path of the electronic semiconductor switch is connected to control the first controlled switch (13) (FIGS. 2, 3).

10. System according to claim 1, wherein the ratio of inductances of said partial primaries is approximately in accordance with the following equality: $\frac{1}{2} L_6 \cdot J^2_{max} = \frac{1}{2} L_{67} \cdot J^2_{min}$, wherein $L_6$ is the inductance of the first partial primary (6); $L_{67}$ is the inductance of both partial primaries (6, 7) in series; $J_{max}$ is the maximum current flow through the first partial primary (6) when the current has reached said predetermined value; and $J_{min}$ is the current flowing through both said partial primaries (6, 7), when serially connected, upon opening of the first controlled switch (13) effecting current flow, serially, through both said partial primaries (6, 7).

* * * * *